United States Patent [19]

Paar

[11] Patent Number: 4,502,428

[45] Date of Patent: Mar. 5, 1985

[54] LASH ADJUSTER WITH FOLLOWER BODY RETAINER

[75] Inventor: Michael S. Paar, Battle Creek, Mich.

[73] Assignee: General Motors Corporation, Detroit, Mich.

[21] Appl. No.: 582,378

[22] Filed: Feb. 22, 1984

[51] Int. Cl.[3] ..... F01L 1/24

[52] U.S. Cl. ..... 123/90.46

[58] Field of Search ..... 123/90.43, 90.46, 90.55

[56] References Cited

U.S. PATENT DOCUMENTS

| | | | |
|---|---|---|---|
| 3,140,698 | 7/1964 | Voorhies | 123/90.46 |
| 3,358,660 | 12/1967 | Cornell | 123/90.55 |
| 4,262,640 | 4/1981 | Clark | 123/90.43 X |

*Primary Examiner*—William R. Cline

*Assistant Examiner*—Peggy A. Neils

*Attorney, Agent, or Firm*—Arthur N. Krein

[57] ABSTRACT

A lash adjuster is retained in unit assembly in a stepped socket of a valve actuator member by means of a normal flat retainer ring, preferably of compliant plastic, that is operatively positioned in an annular groove in the outer peripheral surface of the cylindrical body of the adjuster, the groove being defined by spaced apart sidewalls and an interconnecting base wall, one of the walls being at right angles to the axis of the body and the other wall being inclined at an acute angle to right angle wall whereby during insertion of the lash adjuster into operative position within the socket, the retainer ring can be forced toward the other wall so as to be temporarily deformed into a frustoconical configuration.

2 Claims, 3 Drawing Figures

LASH ADJUSTER WITH FOLLOWER BODY RETAINER

This invention relates to hydraulic lash adjusters and, in particular, to a follower body retainer for securing the follower body of such an adjuster in unit assembly in the body socket of an associate valve train member.

DESCRIPTION OF THE PRIOR ART

Lash adjusters of the hydraulic type are used in the valve operating mechanisms of internal combustion engines to maintain substantially zero lash. In various valve train arrangements, such a hydraulic lash adjuster is operatively positioned in an adjuster receiving bore provided, for example, in either a rocker arm or in a tappet member as used in a direct acting valve gear. For ease in engine assembly, the lash adjuster is normally retained in unit assembly with such associate member by a suitable retainer means.

As is well known, such retainer means is conventionally in the form of a spring steel retainer ring that is mounted in an annular groove formed in either the outer peripheral surface of the follower body or in the adjuster receiving bore wall of the associate member.

Such a retainer ring is formed, for example when used in the groove provided in the follower body, to have an inherent bias radially outwardly to cause portions of it to extend outward from the outer peripheral surface of the follower body whereby to define an abutment shoulder which can contact a suitable shoulder in an associate member so as to limit axial movement of the follower body in one direction.

In the smaller size lash adjusters presently being used, space limitations require that the wire size of the retainer and its mounting groove be proportioned accordingly. Because of this, for example, the holding power of the retainer can be substantially reduced.

It has also been found that if, for example, such a steel retainer ring is used to hold a lash adjuster in unit assembly in a rocker arm made of aluminum, as the lash adjuster with the steel retainer ring is forced into the adjuster receiving bore, the normally outward biased ends of the steel retainer ring can scratch or mar the bore wall. Such scratching can possibly inadvertently create an oil leakage path.

SUMMARY OF THE INVENTION

The present invention relates to a retainer means for retaining a lash adjuster in unit assembly in an adjuster receiving bore provided in an associate member, the retainer means including a normally flat retainer ring positioned in an annular groove, preferably on the follower body of the adjuster, one side of the groove being inclined so that the retainer ring can be deformed into a frustoconical configuration during assembly of the follower body and retainer ring into the adjuster receiving bore.

It is therefore a primary object of this invention to provide a lash adjuster with a follower body retainer that is operative to permit unit assembly of the lash adjuster into the adjuster receiving bore of an associate member without causing damage to the bore wall.

Another object of this invention is to provide a lash adjuster with a follower body retainer wherein the retainer is in the form of a normally flat ring of compliant material that is operatively positioned in an annular groove that is configured on one side thereof to permit temporary deformation of the ring into a frustoconical configuration whereby to reduce its effective outer diameter.

A further object of this invention is to provide a lash adjuster with a follower body retainer wherein the retainer is in the form of a flat ring, preferably of plastic, that is operatively positioned in an annular groove in the follower body, the groove being shaped so that the ring is normally operative to provide an abutment shoulder extending radially outward from the follower body while still permitting temporary deformation of the ring into a frustoconical configuration whereby it can be inserted through an adjuster receiving bore in an associate member.

For a better understanding of the invention as well as other objects and further features thereof, reference is had to the following detailed description of the invention to be read in connection with the accompanying drawings.

Figure 1:
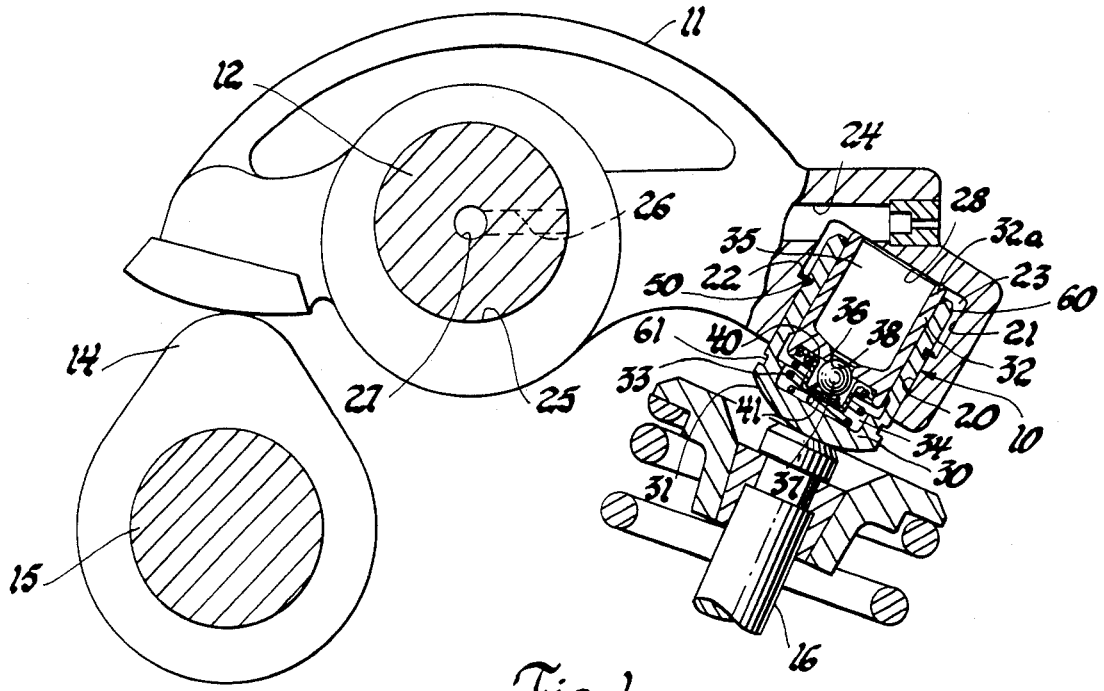
FIG. 1 is a schematic view in partial cross-section of a lash adjuster with follower body retainer of the invention mounted in the rocker arm of a valve train of an engine, the follower body of the lash adjuster being shown, for purposes of illustration only, in an axial position so that the retainer ring abuts an internal shoulder of the rocker arm.

Referring first to FIG. 1, the lash adjuster, generally designated 10, with follower body retainer in accordance with the invention is shown mounted in a valve actuator member, which for purpose of illustration is a rocker arm 11 in an engine valve train of the type wherein the rocker arm is pivotably mounted on a fixed rocker shaft 12 in position to impart motion from the cam 14 on an engine camshaft 15 to a poppet valve 16, which valve can be either an intake valve or an exhaust valve.

Although the lash adjuster 10 can be supported in either end of the rocker arm 11, in the construction shown, it is positioned in the valve end of the rocker arm. For this purpose, the valve end of the rocker arm 11 is provided with an adjuster receiving socket provided by a stepped blind bore that defines an adjuster receiving bore wall 20 extending from the lower end of the rocker arm and an upper wall 21 of an internal diameter greater than the adjuster receiving bore wall 20, with these walls 20, 21 being interconnected by a flat shoulder 22.

The enlarged diameter upper wall 21 defines a fluid reservoir 23 which is in communication with one end of a bored passage 24 that extends through the rocker arm 11 so as to open through rocker shaft receiving bore wall 25 encircling the rocker shaft 12 in position for flow communication with a radial riser passage 26 in the rocker shaft. In a conventional manner, the riser passage 26 is in flow communication with an axial extending passage 27 in the rocker shaft that is in continuous communication with the pressurized lubricant oil supply of the engine through suitable interconnecting passage means, not shown.

The lash adjuster 10 includes an upwardly presenting, cup-shaped follower body 30 whose closed end 31 rests on the upper stem end of the poppet valve 16. A plunger 32 has a close sliding fit for reciprocation within the follower body 30, and is normally biased upwardly therein by a plunger spring 33 so that its upper end 32*a* normally abuts against the internal wall 28 of the rocker arm at the closed end of the adjuster receiving socket therein. The spring 33 also acts against the closed end of the follower body 30 to maintain it in abutment with the stem of the poppet valve 16.

The lower end of the plunger 32 forms with the closed end of the follower body 30 a pressure chamber 34 while the upper open end of the plunger 32 defines a supply chamber 35 that is in continuous flow communication with the fluid reservoir 23 in the embodiment illustrated. The supply chamber 35 is in flow communication with the pressure chamber 34 via an axial port 36, flow through which is controlled by a one-way valve in the form of a ball 37 which closes against a seat 38 of the plunger that encircles port 36.

A suitable valve cage 40 and valve return spring 41 limits open travel of the valve ball 37 to the amount necessary to accommodate replenishment of the pressure chamber 34 with oil which normally escapes therefrom between the sliding surfaces of the plunger 32 and follower body 30 as "leak-down" during cam induced opening movements of the poppet valve 16. As shown, the valve cage 40 is held in position against the plunger 32 by the plunger spring 33.

The lash adjuster 10, as thus far described, is somewhat typical of commercially available hydraulic lash adjusters.

Now in accordance with the invention, the lash adjuster 10 is maintained in unit assembly within the adjuster receiving socket within the rocker arm 11 by means of a retainer ring 50 operatively positioned in an annular groove 51 to be described in detail hereinafter that is provided in the follower body 30.

The retainer ring 50, similar to a washer, is formed of thin spring metal or of a suitable, compliant plastic material, the plastic being preferred for reasons to be described in detail hereinafter. The retainer ring 50, as formed is flat but is capable of being temporarly deformed into a frustoconical configuration, and thereafter, because of the memory of the material from which it is fabricated, to return to its original flat configuration. The retainer ring 50 is formed with a nominal outside diameter a predetermined amount greater than the outside diameter of the follower body 30 and of the internal diameter of bore wall 20 in the rocker arm 11 and with a nominal internal diameter a predetermined amount less than the outside diameter of the follower body 30 but greater than the outside diameter of the base 54 of the retainer groove 5 to be described next hereinafter.

Figure 2:
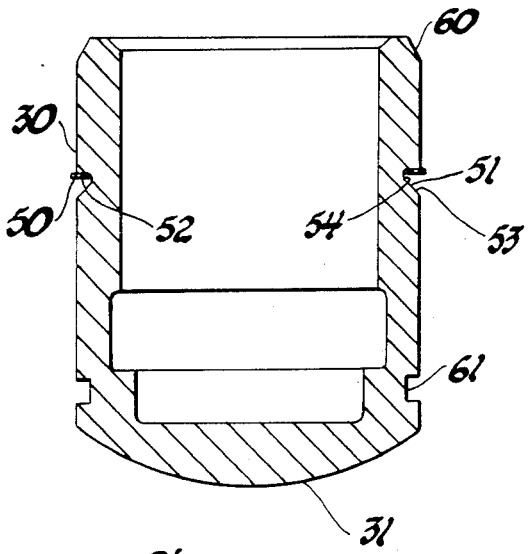
FIG. 2 is a sectional view of the follower body and retainer, per se, of the lash adjuster of FIG. 1; and, FIG. 3 is an enlarged view of a portion of the follower body, retainer, and rocker arm of FIG. 1 showing schematically alternate positions of the retainer.
Figure 3:
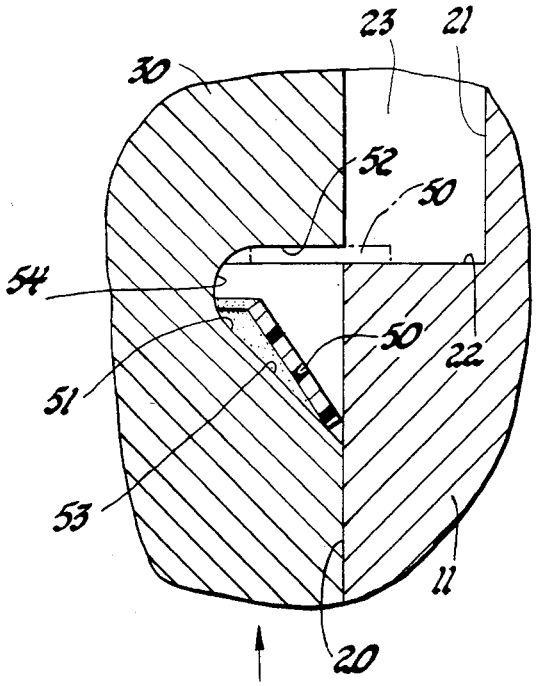

The retainer groove 51 provided in the follower body 30 a predetermined distance down from the upper open end thereof is formed whereby it is defined by a first side wall 52 extending in a plane that is substantially normal to the axis of the follower body 30, an opposed inclined side wall 53 and an arcuate interconnecting base 54, as best seen in FIGS. 2 and 3. In the construction shown, the inclined side wall 53 is inclined at an angle to the longitudinal axis of the follower body 30 and thus the walls 52 and 53, in effect, define an acute angle with the axial spacing between the bases of these walls as interconnected by base 54 being such that the retainer ring 50 is loosely received in the retainer groove 51.

To effect retention of the lash adjuster 10 within the rocker arm 11, the upper inner surface of the retainer ring 50, with reference to FIGS. 1–3, is adapted to abut against the side wall 52 while the lower outer surface of the retainer ring 50 is positioned to engage the shoulder 22 in the rocker arm 11, the position shown in FIG. 1.

However, during assembly of the lash adjuster 10 into the adjuster receiving socket in rocker arm 11, with the retainer ring 50 previously assembled into the groove 51 in the follower body 30, the follower body 30 and bore wall 20 in the rocker arm 11 somewhat like a punch and die set to effect temporary deformation of the retainer ring 50 into a frustoconical configuration. Thus as shown schematically by the solid line drawing of the retainer ring 50 in FIG. 3, as the follower body 30 is inserted in the direction of the arrow in this Figure through the bore wall 20, the outer peripheral edge of the retainer ring 50, engaging first the bottom surface of the rocker arm and then bore wall 20 cause bending of the retainer ring 50 out of its normal flat plane into the frustoconical configuration within the groove 51, thus reducing the then effective outside diameter of the retainer ring 50 sufficiently to allow its passage through the bore wall 20 into the reservoir chamber 23. As the latter occurs, the memory of the material of the retainer ring 50 allows it to regain its normal flat configuration to thereby form, in effect, an annular abutment shoulder extending radially outward from the follower body 30 for engagement with the internal shoulder 22 of the rocker arm 11.

The retainer ring 50 can be formed as a continuous ring or a split ring and is preferably formed as a solid, i.e., continuous ring, for example, and preferably of a plastic such as Nylon 6/6 for the following reasons:

If made of a plastic material, the retainer ring will not scratch or mar a receiving bore wall of relatively soft metal, such as in an aluminum rocker arm;

It can be fabricated inexpensively, as by stamping from an inexpensive flat sheet material;

Being a continuous ring, it provides a reasonably strong abutment shoulder means so as to prevent possible hydraulic blow-out of the lash adjuster during engine operation while still permitting the mechanical removal of the lash adjuster for repair or replacement, if required.

For this latter purpose, the follower body 30 is provided with an accessible tool engaging means whereby sufficient axial force in an outward removal direction can be applied to the follower body 30 so as to shear or break the plastic retainer ring 50 to effect removal of the lash adjuster 10. Of course the then broken retainer ring would have to be removed from the rocker arm and be replaced by a new inexpensive retainer ring.

In the construction shown, the tool engaging means is in the form of an annular groove 61 provided on the follower body 30 at a location spaced from the groove 51 a suitable distance greater than the axial extent of the bore wall 20 whereby it is accessible from the exterior of the rocker arm 11 so that a suitable tool, such as a screwdriver, can be inserted therein to forceably pry the lash adjuster outward from the rocker arm 11.

To permit assembly of such a continuous plastic retainer ring 50 into the groove 51 in the follower body 30, this body is provided with a chamfered surface 60 at its upper open end to thus define a "bullet nose" whereby the retainer ring can be pulled and stretched over the following body 30 until it enters the groove 51.

By way of an example, in a particular application, the follower body 30 had an outside diameter of approximately 14.5 mm, the base 54 of the groove 51 had a diameter of 13.2–13.4 mm; and, the wall 53 was inclined at an angle of 45° to the axis of the follower body 30 to define a groove width of 0.95 mm. For this application the retainer ring 50 made of commercially available nylon 6/6 of a thickness of 0.15 mm had as flat formed an outside diameter of 14.85 mm and an internal diameter of 13.66 mm.

It is to be understood that although the invention has been described and illustrated with reference to the unit assembly of a rocker arm and hydraulic lash adjuster, the retaining means of the invention can be used in various other type valve train members, such as, for example, in direct acting tappet type hydraulic lifters.

Accordingly, while the invention has been described with reference to the structure disclosed herein, it is not confined to the specific details set forth, since it is apparent that various modifications and changes can be made by those skilled in the art. For example, the retainer ring, instead of being uniformly round so as to define inner and outer circular abutment shoulders, can be provided with either inward or outward spaced apart lip portions to serve the same function as one of the abutment shoulders as used in other well known forms of retainer rings. This application is therefore intended to cover such modifications or changes as may come within the purposes of the improvements or scope of the following claims.

The embodiments of an invention in which an exclusive property or privilege is claimed are defined as follows:

1. An integral valve actuator member and hydraulic lash adjuster assembly including a valve actuator member having a stepped blind socket bore extending from one surface thereof so as to define an internal cylindrical adjuster guide wall next adjacent to said one surface, an enlarged wall defining a reservoir adapted to be supplied with hydraulic fluid under pressure and, an abutment shoulder interconnecting said walls; a hydraulic lash adjuster having a cylindrical body slidably received in said adjuster guide wall with one end thereof loosely received in said reservoir, said body having an annular groove on its outer peripheral surface next adjacent to said one end that is defined by spaced apart sidewalls and an interconnecting lower arcuate base wall, one of said sidewalls next adjacent to said one end defining a transverse shoulder that extends at substantially right angles to the longitudinal axis of said body and the other one of said sidewalls forming an acute angle with said transverse shoulder; and, an annular, normally flat, ring-like retainer of deformable compliant material operatively positioned in said annular groove in said body, said retainer having an outside diameter greater than the internal diameter of said adjuster guide wall and an inside diameter complementary to the outside diameter of said base wall, said retainer being adapted to be temporarily deformed into a frustoconical configuration during insertion of said body of said hydraulic lash adjuster and said retainer into said adjuster guide wall and to then return to its normal flat configuration whereby it can then function so that opposite sides thereof will abut against said transverse shoulder and said abutment shoulder.

2. An integral rocker arm and hydraulic lash adjuster assembly including a rocker arm having a stepped adjuster receiving socket defined by an internal cylindrical adjuster guide wall extending from one surface of the rocker arm, an enlarged wall defining a reservoir adapted to be supplied with hydraulic fluid under pressure and, an abutment shoulder interconnecting said walls; a hydraulic lash adjuster including a cylindrical follower body slidably received in said adjuster guide wall with one end of said follower body slidably extending through said guide wall into said reservoir, said follower body having an annular groove on its outer peripheral surface next adjacent to said one end defined by a first wall defining a transverse shoulder that extends at substantially right angles to the longitudinal axis of said body and a second wall in spaced apart relation to said first wall and interconnected therewith by a base wall, said second wall being inclined at an acute angle to said transverse shoulder; and, an annular, normally flat, ring-like retainer of compliant material operatively positioned in said annular groove in said follower body, said retainer having an outside diameter greater than the internal diameter of said adjuster guide wall and an inside diameter complementary to the outside diameter of said base wall, said retainer being adapted to be temporarily deformed into a frustoconical configuration during insertion of said follower body through said adjuster guide wall and to then return to its normal flat configuration so as to engage said abutment shoulder to effect retention of said lash adjuster in said rocker arm.

* * * * *